US008109369B2

(12) United States Patent
Fischer

(10) Patent No.: US 8,109,369 B2
(45) Date of Patent: Feb. 7, 2012

(54) METHOD OF OPTIMIZING THE WEIGHT OF A COUNTERWEIGHT OF AN ELEVATOR SYSTEM AND ELEVATOR SYSTEM WITH A COUNTERWEIGHT OF THAT KIND

(75) Inventor: Daniel Fischer, Ollon (CH)

(73) Assignee: Inventio AG, Hergiswil NW (CH)

( * ) Notice: Subject to any disclaimer, the term of this patent is extended or adjusted under 35 U.S.C. 154(b) by 192 days.

(21) Appl. No.: 11/780,076

(22) Filed: Jul. 19, 2007

(65) Prior Publication Data

US 2008/0017454 A1 Jan. 24, 2008

(30) Foreign Application Priority Data

Jul. 21, 2006 (EP) ..... 06117643

(51) Int. Cl.
*B66B 17/12* (2006.01)
*B66B 11/08* (2006.01)
*B66B 11/00* (2006.01)

(52) U.S. Cl. ..... 187/404; 187/254

(58) Field of Classification Search ..... 187/404, 187/414, 405; *B66B 17/12, 7/00, 11/00, B66B 11/08*

See application file for complete search history.

(56) References Cited

U.S. PATENT DOCUMENTS 3,845,842 A * 11/1974 Johnson ..... 187/266
3,878,916 A * 4/1975 White, Jr. ..... 182/145
5,441,127 A * 8/1995 Ikejima et al. ..... 181/292
5,984,052 A 11/1999 Cloux
2002/0125079 A1 * 9/2002 Mattlar et al. ..... 187/375
2005/0006180 A1 * 1/2005 Mustalahti et al. ..... 187/254
2010/0133046 A1 * 6/2010 Allwardt et al. ..... 187/251

FOREIGN PATENT DOCUMENTS

EP 1 600 417 A 11/2005
EP 1880970 A2 * 1/2008
JP 2002234680 A * 8/2002
JP 2003040554 A * 2/2003
JP 2005187156 A * 7/2005
JP 2010208772 A * 9/2010

OTHER PUBLICATIONS

Phillips R.S.: "Electric Lifts" Manual on the Current Practice in the Design, Installation, Working and Maintenance of Lifts, London, Pitman, GB, 1951 pp. 82, 83 and 145.

* cited by examiner

*Primary Examiner* — Michael Mansen
*Assistant Examiner* — Stefan Kruer
(74) *Attorney, Agent, or Firm* — Fraser Clemens Martin & Miller; William J. Clemens

(57) ABSTRACT

An elevator system includes a car with an empty weight MK, which car can move a rated load MLmax, a counterweight, which is coupled with the car by a support device so that it rises when the car lowers and lowers when the car rises, as well as a drive device which can apply a maximum traction force MFmax to the support means. According to the present invention the drive device is selected in such a manner that the maximum traction force MFmax is at least greater than half the rated load MLmax (MFmax>0.5×MLmax) and the weight MG of the counterweight is optimized in such a manner that it is substantially equal to the empty weight MK and the difference between the rated load MLmax of the car and the maximum traction force MFmax of the selected drive device (MG≈MK+(MLmax−MFmax)).

14 Claims, 2 Drawing Sheets

METHOD OF OPTIMIZING THE WEIGHT OF A COUNTERWEIGHT OF AN ELEVATOR SYSTEM AND ELEVATOR SYSTEM WITH A COUNTERWEIGHT OF THAT KIND

FIELD OF THE INVENTION

The present invention relates to a method of optimizing the weight of a counterweight of an elevator system having a car connected to the counterweight by a driving means, as well as to an elevator system with a counterweight of that kind.

BACKGROUND OF THE INVENTION

An elevator system generally comprises a car for transporting persons or loads, which is raised, lowered or kept at a height by way of a driving means, for example a traction cable. For this purpose a drive means applies a corresponding traction force to a driving means. The elevator system is usually designed for transporting a permissible useful load or rated load. In normal use of the elevator system the load varies between zero (empty) and the rated load.

The drive means comprises a motor, the drive output torque or lifting force of which is converted into a traction force on the driving means. This motor can in that case exert, by virtue of its construction, a defined maximum lifting force in continuous operation or operation for a time. For example, the heat dissipation limits the continuous power of electric motors in continuous operation. In operation over a time, during which the motor can for a short time usually apply a higher lifting force, the maximum power take-up limits the maximum lifting force.

The static holding force for holding the car at a height can similarly be applied by the motor or advantageously by a brake, which can be integrated in the motor or can separately apply a holding force to the driving means. Since brakes with simple means can apply high brake (holding) moments, the static holding force generated by the brake is usually greater than the (continuous) lifting force able to be applied by the motor.

For reducing the holding or lifting force to be produced by the drive means it is known from, for example, U.S. Pat. No. 5,984,052 to so couple a counterweight with the car by way of a support means that it rises when the car lowers and lowers when the car rises. The support means can be identical with the driving means or separate therefrom and fixedly connected with the car and/or the drive. For the sake of simplicity, driving means is used herein interchangeably with the term "support means".

The weight of this counterweight is usually so selected that it substantially corresponds with the sum of the empty weight and half the rated load of the car. The maximum traction force which the drive means has to apply for raising, holding or lowering the car is thus minimized. At half rated load the elevator system is balanced, i.e. the drive means does not have to apply a holding force and only friction forces have to be overcome when raising or lowering. The maximum traction force then occurs when the car is empty (in the case of which the counterweight pulls downwardly) and a full car (in the case of which the car pulls downwardly). The drive means is in that case selected so that on the one hand it can apply this maximum traction force as a static holding force and on the other hand compensation can additionally also be provided for the inertia forces, which arise at a nominal speed profile, of the car inclusive of load as well as of the counterweight in continuous lifting operation or lifting operation for a time.

In departure therefrom U.S. Pat. No. 5,984,052 proposes selecting the counterweight so that it corresponds with the sum of the empty weight and a statistical mean value of the load distribution, which in the example of embodiment is assumed as 30% of the rated load. Such an elevator system is balanced at the statistical mean, i.e. requires only small holding and lifting forces during a large proportion of the daily operation. Insofar as, however, the car in the example of embodiment conveys more than 40% of the rated load, the traction force to be applied by the drive means increases relative to the previously described elevator system balanced at 50% and exceeds, from 80% of the rated load, the maximum traction force, which can be applied, of the elevator system balanced at 50%.

In this region the same drive means can no longer provide compensation for the same inertia forces. Accordingly, U.S. Pat. No. 5,984,052 proposes changing the nominal speed profile from a specific percentage load value and continuing to operate only with lower accelerations.

The balancing proposed by U.S. Pat. No. 5,984,052 disadvantageously requires complicated empirical determination of the load mean value. Insofar as the load distribution in actual operation departs from the distribution fundamental to the design of the weight of the counterweight, the elevator system operates in sub-optimal manner. In addition, in the case of a large standard deviation from the mean value, i.e. if loads strongly deviating from the mean value frequently occur, the efficiency of this elevator system worsens.

The conventional 50% balancing requires relatively large counterweights. These are disadvantageous in production, mounting and maintenance. In particular, large counterweights disadvantageously require additional constructional space in the elevator shaft. The balancing at a statistical mean value of load considerably reduces transport capacity in full-load operation, since the nominal speed is reduced just in this operational state.

SUMMARY OF THE INVENTION

It is therefore an object of the present invention to provide an elevator system which avoids the above-mentioned disadvantages. In particular, it is an object of the present invention to provide a method and an elevator system which is more favorable with respect to production, assembly, maintenance and/or the required constructional space in the elevator shaft.

A method according to the present invention is developed for fulfilling this task. The present invention provides a method by which a counterweight can be appropriately optimized.

A method according to the present invention utilizes a car with an empty weight MK, which car can move a rated load MLmax. Fastened to the car is a support means to which a drive means can apply a traction force in such a manner that the car rises, lowers or is held at a predetermined height. In that case the drive means can apply a maximum traction force MFmax as a static holding force MFmaxA, as a dynamic time-extended lifting force MFmaxUD and/or as a time-limited lifting force MFmaxUZ.

As a rule the dynamic lifting force, which in addition to the weight force must also provide compensation for inertia and friction forces, is greater than the static holding force. In that case the time-limited lifting force, which can be produced by the drive means for a short time, is generally greater than the time-extended lifting force, which the drive means can apply over a longer period of time. Conversely, particularly to the extent that the drive means advantageously comprises a brake which can be integrated in a motor or can be constructed separately therefrom, the maximum static holding force MFmaxA producible by the drive means can also exceed the dynamic lifting force MFmaxU. Thus, in particular, safety brakes in elevator systems can exceed the nominal outputs of the drive motors so as to be able to safely brake and hold the cars in the case of failure of the motors. In order to be able to provide secure compensation for the inertia forces which occur in the case of such emergency braking and which can exceed the dynamic loads in normal operation, the brakes can be dimensioned to be of appropriate strength.

The elevator system according to the present invention further comprises a counterweight which is so coupled with the car by way of a support means that it rises when the car lowers and lowers when the car rises.

According to the present invention it is now proposed that the weight MG of the counterweight substantially corresponds with the sum of the empty weight MK and the difference between the maximum traction force MFmax of the drive means and the rated load MLmax of the car, in equation form:

$$MG \approx MK + (MLmax - MFmax) \quad (1)$$

The weight of the counterweight does not have to exactly correspond with the sum of the empty weight and the difference between the maximum traction force and the rated load. In particular, the counterweight can, as is explained in the following, be selected to be somewhat greater so as to take into consideration inertia and friction forces as well as additional weights of the support means, so that:

$$MG \geqq MK + (MLmax - MFmax) \quad (2)$$

The drive means can, conditioned by the mode of construction, apply at most a traction force MFmax. This is always at least greater than half the rated load MLmax, since otherwise the drive means could not hold or raise and lower either the full or the empty car:

$$MFmax > 0.5 \times MLmax \quad (3)$$

According to the present invention the weight of the counterweight is now so selected that the drive means can just hold, or at the nominal speed profile raise and lower, the car with coupled counterweight. In this connection the safety factors required for the elevator system are, for example, taken into consideration in that a quotient of the maximum traction force, which is conditioned by the mode of construction, of the drive means and a corresponding factor is used as the maximum traction force MFmax in Equations (1) and (2), respectively. A typical values range of this safety area is 1.1 to 2.0. Thus, usual acceleration and inertia influences, friction losses, support means displacements or overload reserves can be taken into consideration. This safety factor is usually fixed for specific elevator categories. This safety factor preferably amounts to approximately 1.3. This value has proved itself in passenger elevators with, for example, up to 10 floors. This safety factor can obviously already be included in the statement of the maximum traction force MFmax of the drive means. In that case this safety factor no longer has to be taken into consideration in the optimization of the counterweight.

By contrast to the previous design of the weight of the counterweight where either the requisite maximum traction force of the drive means is minimized (50% balancing) or the requisite traction force of the drive means is minimized in the statistical mean, it is thus proposed in accordance with the invention to fully utilize the traction force available from a drive means and then optimize or minimize the weight of the counterweight.

In this connection it is advantageously possible to select the drive means from a product line of a plurality of drive means with predetermined graduated traction forces. In a first step in that case there is selection of that drive means with the smallest maximum traction force sufficient to raise, lower or hold the car with a 50% balancing, because with a 50% balancing the requisite maximum traction force is minimal, so that the drive means has to be able in every case to exert this maximum traction force which is as small as possible depending on the balancing.

In graduated product lines the maximum traction force of the individual types usually does not correspond with the thus-determined smallest maximum traction force, which is dependent on the empty and rated load weight of the car, friction values, weights of the support means, safety factors and similar, for a concrete case of use. Accordingly, in the first step there is selection from the product line of that drive means of which the maximum traction force exceeds this smallest required maximum traction force.

The drive means selected in such a manner would therefore make available more maximum traction force than required for the concrete case of use. According to the present invention this excess is utilized in order to optimize the weight of the counterweight as far as possible, i.e. to minimize it, because a counterweight which is not balanced at 50% requires in the boundary case of an empty or maximally loaded car a higher traction force for raising, lowering or holding the car. This higher traction force can, however, just be produced by the drive means selected from the production line and to that extent over-dimensioned.

On the other hand it is not necessary, as in U.S. Pat. No. 5,984,052, to change the nominal speed profile for higher loads, since according to the present invention the weight of the counterweight is only minimized to the extent that the car can move over its full load distribution at the desired nominal speed profile. This is because according to the present invention the weight of the counterweight is reduced only to the extent that the drive means can raise or lower the car in all operational states with the desired speed profiles. The transport capacity is thereby increased at full-load operation.

The selection in accordance with the present invention of the weight of the counterweight thereby represents an optimal compromise between a 50% balancing with minimal traction force in the boundary case and a balancing to the statistical load mean value at which the traction force is minimal in the statistical mean. It allows, in particular, the drive means to be selected from a product line with predetermined stepped traction forces and thus makes it possible to fall back on economic mass-production drive means, to nevertheless utilize these optimally and to minimize costs of the elevator system.

A minimum counterweight brings a number of advantages: On the one hand material costs are saved already in manufacture. On the other hand the handling of a smaller counterweight in production, transport to the place of use, mounting in the elevator shaft, maintenance and demounting are significantly simplified. Finally, a smaller counterweight advantageously requires less space in the elevator shaft (or a separate shaft). In a limit case the weight of the counterweight could even be made so light that the counterweight is equal to the weight of the empty car. As Stawinoga has shown in the technical publication "Elevatorreport" of September/October 1996 it could be possible in this case to dispense with further measures for protection against uncontrolled upward movements.

The support means can comprise one or more cables and/or one or more belts. As a rule, support and driving means are identical, i.e. cable or cables and/or belt or belts, which is or are fastened to the car and the counterweight and deflected over floating and/or fixed rollers and/or one or more drive pulleys.

Preferably one or more cables and/or belts of the support means is or are coated with an elastomer, particularly polyurethane. This increases, in particular, the tractive or drive capability of the support means. As is known, in the case of deflection over a drive pulley the counterweight must, according to the Euler-Eytelwein formula, amount to at least $e^{\mu\alpha}$ of the car weight with the coefficient of friction $\mu$ between drive pulley and support means and the deflection angle $\alpha$. An increase in the coefficient of friction by the advantageous coating thus allows a reduction in the weight of the counterweight.

The drive means preferably comprises a motor, especially a frequency-regulated electric motor, and can have at least one drive pulley for conversion of a drive output torque of the motor into a traction force on the support means. A brake integrated in the motor or separate from this and able to exert a static holding moment on the at least one drive pulley can be provided. All known friction-locking and/or shape-locking brakes come into consideration as brakes.

The smaller value of the static holding force MFmaxA by which the drive means keeps the car at a height, the dynamic time-extended lifting force MFmaxUD by which the drive means can raise the car during a longer period of time and/or the dynamic time-limited lifting force MFmaxUZ by which the drive means can raise the car over a short time is or are preferably calculated as maximum traction force MFmax of the drive means. As explained in the introduction, particularly in the case of safety brakes the static holding force MFmaxA can exceed the dynamic lifting force MFmaxU. Conversely, in the case of, for example, pure motor brakes the static time-extended holding force can exceed the dynamic (time-limited) lifting force. In order to ensure not only a secure raising and lowering, i.e. a sufficient dynamic lifting force of the drive means, but also a secure holding of the car at a height, i.e. a sufficient static lifting force of the drive means, it is proposed to base the design of the weight of the counterweight on the smallest of these values.

In the design of the weight of the counterweight the weight of the counterweight and/or the empty weight of the car and the rated load of the car is or are reduced, on the basis of laws known for block-and-tackle systems, in correspondence with the number of floating rollers about which the support means is deflected. Thus, in Equation (1) or (2) the weight of the counterweight MG or the empty weight MK and the rated load MLmax can be divided by, for example, a suspension factor of two when the support means is deflected once respectively at the car side and counterweight side around a floating roller (one time). In the case of a multiple suspension (i.e. four times, five times, etc.) the divisor for design of the weights changes correspondingly. In the case of a direct suspension, without floating rollers, this divisor is eliminated or it is equal to one.

The empty weight of the car and/or the maximum traction force of the drive means and/or the rated load of the car can be increased by the safety factor for consideration of the inertia forces, which occur in operation, for Equation (1) or (2) in a manner known per se. Equally, friction and/or the weight of the support means and/or support means can be taken into consideration in Equation (1) or (2).

The present invention proposes a method for design of the weight of the counterweight of an elevator system by which this weight can be optimized for a drive means with predetermined maximum traction force. Equally, the present invention relates to an elevator system with a counterweight designed in accordance with this method.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
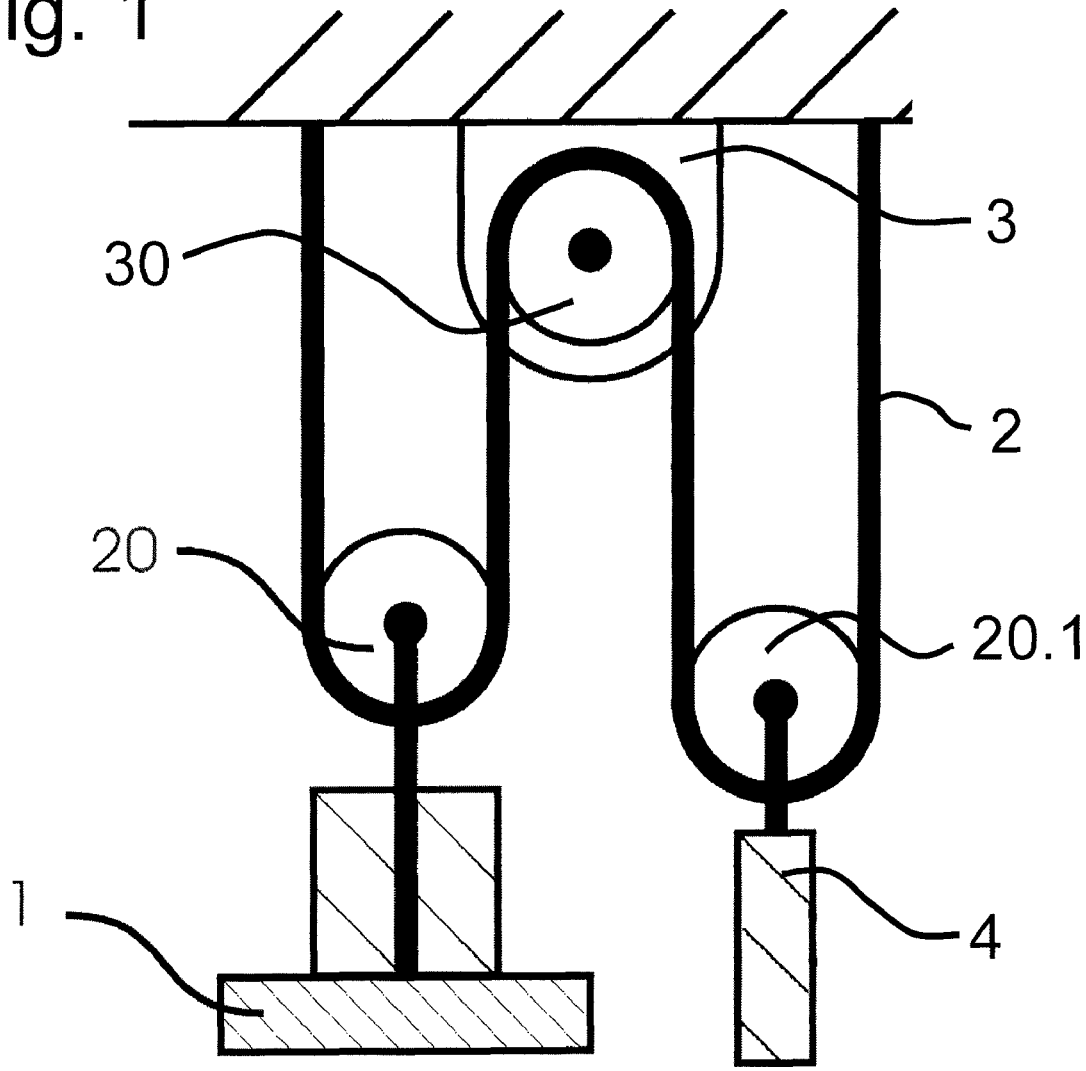
FIG. 1 shows, schematically, the construction of an elevator system according to an embodiment of the present invention.

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

The figures use the same reference numerals for comparable components.

An elevator system according to one embodiment of the present invention comprises, as schematically illustrated in FIG. 1, a car 1 with an empty weight MK, which car can raise or lower a load ML or hold it at a specific height. The load ML can correspond with a rated load MLmax.

A support means or device 2, which here is indicated as a single cable, is fastened to the car 1 by way of a floating roller 20. This cable is fixed at one end in a shaft region, is subsequently deflected over the floating roller 20, in the following loops around a drive pulley 30, is deflected at its other end over a counterweight floating roller 20.1 and again fixedly connected with the shaft.

A drive means or device 3 comprises a motor and a brake (in each instance not illustrated in detail), which can apply a lifting torque and holding torque to the drive pulley 30. This torque is converted in friction-locking manner to a traction force in the cable 2 looping around the drive pulley 30, so that the car 1 rises, lowers or is held at a height as a consequence of the lifting or holding torque.

The drive means 3 can, conditioned by its construction, apply the maximum static holding force MFmaxA by way of its brake, and the maximum dynamic time-extended lifting force MFmaxUD and maximum dynamic time-limited lifting force MFmaxUZ by way of its motor. In that case the static holding force able to be applied by the brake is, depending on the respective type of drive means, greater or smaller than the dynamic time-limited lifting force which the motor can apply for a short time. Due to the limited heat dissipation, this is in turn greater than the dynamic time-extended lifting force which the motor can deliver over a longer period of time.

As apparent from the schematic illustration of FIG. 1, a counterweight 4 is so coupled with the car 1 by way of the support means 2, which in the example of embodiment is identical with the driving means, that it rises when the car 1 lowers and lowers when the car 1 rises. By virtue of this balancing the traction force which the drive means 3 has to apply or transfer to the support means 2 reduces in known manner.

In the example of embodiment the elevator system outlined in FIG. 1 is designed as follows: Initially the empty weight MK of the car 1 and the rated load MLmax of the elevator system are determined. In the example of embodiment the empty car 1 weighs 1600 kg and the rated load may be estimated at 2,000 kg.

By virtue of the floating rollers 20, 20.1 these weights are halved in the following calculations, since the drive means has to apply only half the traction force by virtue of the block-and-tackle system (MK=800 kg; MLmax=1000 kg).

Four types of a drive product line are available as the possible drive means 3:

| Type | maximum holding force MFmaxA | maximum time-extended lifting force MFmaxUD | maximum time-limited lifting force MFmaxUZ |
|---|---|---|---|
| Type I | 1250 kg | 1250 kg | 1500 kg |
| Type II | 1250 kg | 1000 kg | 1200 kg |
| Type III | 500 kg | 750 kg | 800 kg |
| Type IV | 500 kg | 450 kg | 600 kg |

As is recognizable from the values in the second column, Types I and II or III and IV each have the same mechanical brake, but different drive motors. As is recognizable from the values in the fourth column, the lifting forces which the drive means 3 can apply for a short time exceed those available in time-extended operation.

Initially, in this example all above values are reduced by a factor 1.3 in order to take into consideration a safety factor equal to 1.3 (as previously explained) in the design. This factor takes into consideration, for example, friction influences, inertia forces, special requirements, etc. Subsequently, the smallest maximum traction force is ascertained for each drive means 3 from the holding force, time-extended force and time-limited force (underlined in the above table). This is compared with half the rated load MLmax/2=500 kg according to equation (3), since the drive means 3 would have to exert this half rated load even with a 50% balancing:

$$MFmax > 0.5 \times MLmax > 500 \text{ kg}$$

Whereas Type III with MFmaxA/1.3 (=safety factor)=384 kg is still not sufficient, the drive means Type II with MFmaxUD/1.3=769 kg is that drive with the smallest sufficient traction force which fulfils the condition according to Equation (3) and is selected.

Since, however, this selected drive means 3 can elevator a load of 769 kg even in time-extended operation, whereas in the case of a balancing of 50% only 500 kg would be required, the weight MG of the counterweight 4 can be correspondingly reduced according to Equation (1) with consideration of the above-explained safety factor 1.3, wherein by virtue of the floating roller 20.1 at the counterweight side the weight of the counterweight is in turn doubled:

$$\begin{aligned} MG/2 &= MK + (ML\max - MF\max/1.3) \\ &= 800 \text{ kg} + (1000 \text{ kg} - 769 \text{ kg}) \\ &= 1031 \text{ kg} \end{aligned}$$

-continued $$\begin{aligned} MG &= 2 \times 1031 \text{ kg} \\ &= 2062 \text{ kg} \end{aligned}$$

Advantageously, the counterweight 4 is preferably selected to be somewhat greater in correspondence with one weight step, in the present case to, for example, 2075 kg.

The counterweight 4 is thus minimized relative to a conventional balancing of 50% at which the weight of the counterweight would be 2×(MK+MLmax/2)=2600 kg, wherein by contrast to a 30% balancing, as is known from the example of embodiment of U.S. Pat. No. 5,984,052, it is possible to operate with the same nominal speed profile at all loads, even at rated load. The traction force of the drive means 3 is therefore optimally utilized and at the same time the counterweight 4 is minimized or optimized.

Figure 2:
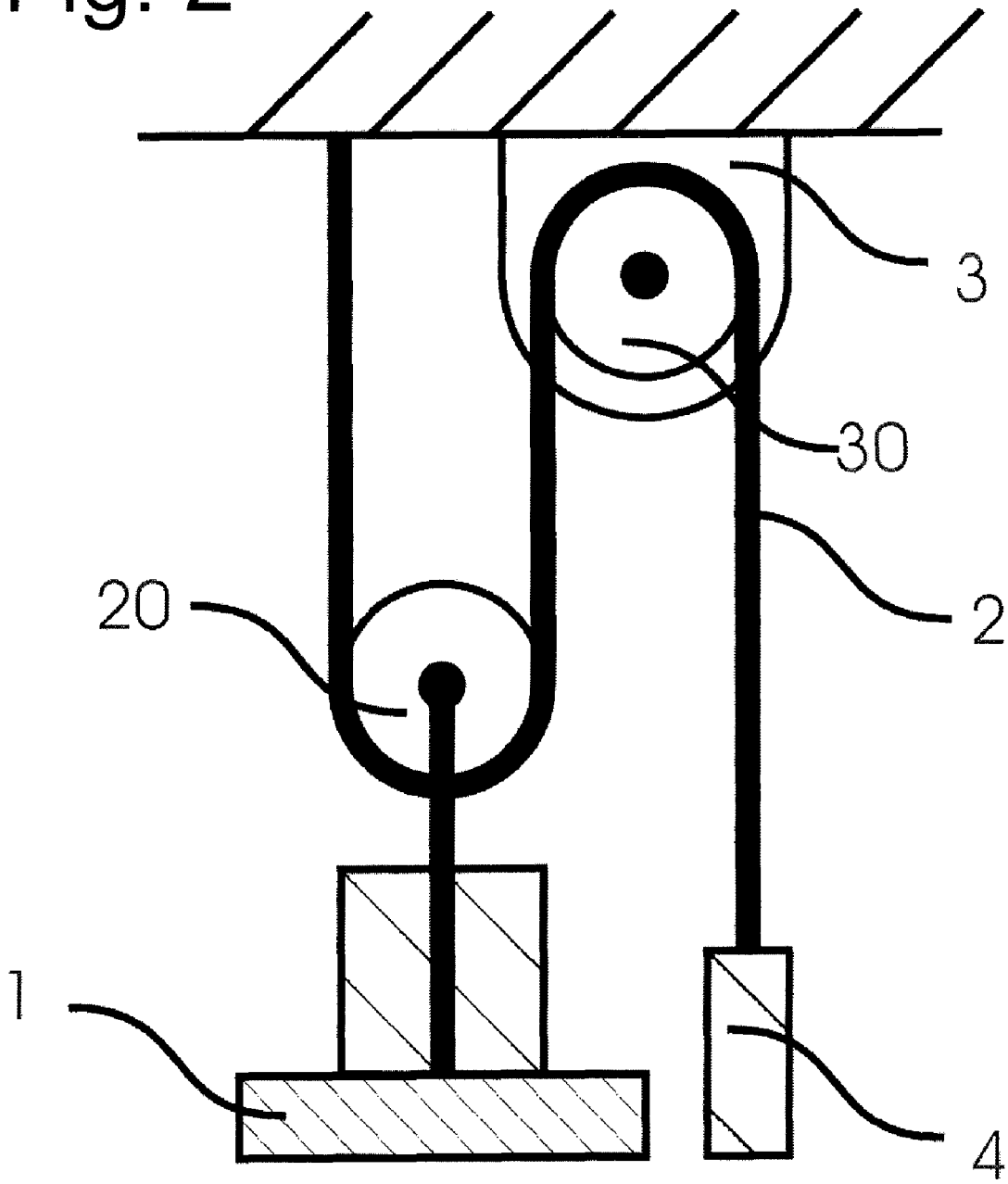
FIG. 2 shows, schematically, the construction of a further elevator system according to an embodiment of the present invention.

In the example illustrated in FIG. 2 the car 1 is merely fastened by way of the one floating roller 20. The support means 2 is fixed at one end in the shaft region, is subsequently deflected over the floating roller 20, in the following loops around the drive pulley 30 and is fixedly connected at its other end with the counterweight 4. In this example the empty weight MK at the car side as well as the rated load MLmax are halved due to the floating roller 20 at the car side. The mass or weight of the counterweight 4 does not, however, have to be doubled again, since a floating roller is not used at the counterweight side. Calculation of the weight of the counterweight 4 is thus carried out as explained above, wherein merely, due to the absent roller 20.1, the weight of the counterweight 4 does not have to be doubled:

$$\begin{aligned} MG &= MK + (ML\max + MF\max/1.3) \\ &= 800 \text{ kg} + (1000 \text{ kg} - 769 \text{ kg}) \\ &= 1031 \text{ kg} \end{aligned}$$

The counterweight 4 was preferably selected to be somewhat larger on the basis of the weight graduation, in the present case at, for example, 1050 kg. This example serves for clarification of the influence of the floating roller 20, 20.1, wherein it is to be noted that in this connection obviously the travel paths of the counterweight 4 and the car 1 result as different, which has to be taken into consideration in the design of the shaft.

Different procedures in the use of the formulae are possible, so that a number of the floating rollers 20, 20.1 can be taken into consideration in the weights of the car 1 and/or the counterweight 4 or the influence thereof can be taken into consideration in the holding force table. Equally, safety factors can be taken into consideration directly in the establishing of the holding forces or they can be taken into consideration in the establishing of the actual weight of the counterweight 4.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method of optimizing a weight of a counterweight of an elevator system, the elevator system consisting of a car, a counterweight which is coupled with the car by a support means so that it rises when the car lowers and lowers when the car rises, and a drive means which can apply a traction force to the support means, the method comprising the steps of:

a. predefining a rated load (MLmax) to be raised and lowered by the elevator system in the car;

b. predefining an empty weight (MK) of the car;

c. selecting the drive means from a plurality of drive means each with a different predetermined maximum traction force (MFmax), wherein the maximum traction force (MFmax) of the selected drive means is at least greater than half the rated load (MFmax>0.5×MLmax);

d. after selecting the drive means, selecting the weight (MG) of the counterweight to be substantially equal to the empty weight (MK) and the difference between the rated load (MLmax) and the maximum traction force (MFmax) of the selected drive means (MG≈MK+(MLmax−MFmax)); and e. providing the selected drive means and the counterweight with the selected weight to the elevator system so that the drive means is able to hold, raise, and lower the car with the coupled counterweight remaining unchanged at the selected weight (MG) at all loads up to the predefined rated load (MLmax), the raising and lowering being at a same nominal speed profile.

2. The method of optimizing the weight of the counterweight of an elevator system according to claim 1 wherein at least one of the empty weight of the car plus the rated load of the car and the weight of the counterweight is increased by a safety factor for consideration of the frictional and inertial forces occurring in operation, or the maximum traction force of the selected drive means is reduced by a safety factor for consideration of the frictional and inertial forces occurring in operation for said step d.

3. The method of optimizing the weight of the counterweight of an elevator system according to claim 2 wherein the safety factor is in a range of 1.1 to 2.0.

4. The method of optimizing the weight of the counterweight of an elevator system according to claim 2 wherein the safety factor is 1.3.

5. The method of optimizing the weight of the counterweight of an elevator system according to claim 1 including providing a motor and at least one. drive pulley as the drive means for converting a drive output torque of the motor into a traction force on the support means.

6. The method of optimizing the weight of the counterweight of an elevator system according to claim 5 including providing a brake in the drive means which can apply a static holding moment to a drive pulley of the drive means.

7. The method of optimizing the weight of the counterweight of an elevator system according to claim 6 including selecting at least one of the motor and the brake from a plurality of motors and brakes each with a different predetermined holding or lifting moment.

8. The method of optimizing the weight of the counterweight of an elevator system according to claim 5 wherein the motor is a frequency-regulated electric motor.

9. The method of optimizing the weight of the counterweight of an elevator system according to claim 1 including using at least one cable or belt as the support means, wherein the at least one cable or belt is coated with an elastomer material.

10. The method of optimizing the weight of the counterweight of an elevator system according to claim 9 wherein the elastomer is polyurethane material.

11. The method of optimizing the weight of the counterweight of an elevator system according to claim 1 wherein a smaller of a value of a static holding force (MFmaxA) by which the drive means holds the car at a height, a value of a dynamic time-extended lifting force (MFmaxUD) by which the drive means can lift the car over a first period of time and a value of a dynamic time-limited lifting force (MFmaxUZ) by which the drive means can lift the car over a second period of time is the maximum traction force (MFmax) of each of the drive means of the plurality of drive means, wherein the first period of time is longer than the second period of time.

12. The method of optimizing the weight of the counterweight of an elevator system according to claim 1 wherein at least one of the weight of the counterweight and the empty weight of the car plus the rated load of the car is reduced in correspondence with a number of floating rollers around which the support means is deflected, or the maximum traction force of the selected drive means is increased in correspondence with the number of floating rollers around which the support means is deflected for said step d.

13. An elevator system comprising:

a car having an empty weight (MK) and which can move a rated load (MLmax);

a counterweight having a weight (MG);

a support means coupling said counterweight to said car so that said counterweight rises when said car lowers and lowers when said car rises; and a drive means which can apply a maximum traction force (MFmax) to said support means, the maximum traction force being at least greater than half the rated load (MFmax>0.5×MLmax), and the weight (MG) of said counterweight being substantially equal to the empty weight (MK) and a difference between the rated load (MLmax) of said car and the maximum traction force (MFmax) of said drive means (MG≈MK+(MLmax−MFmax)) so that the drive means is able to hold, raise, and lower the car with the coupled counterweight remaining unchanged at the weight (MG) at all loads up to the predefined rated load (MLmax), the raising and lowering being at a same nominal speed profile.

14. A method of optimizing a weight of a counterweight of an elevator system, the elevator system consisting of a car, a counterweight which is coupled with the car by a support means so that it rises when the car lowers and lowers when the car rises, and a drive means which can apply a traction force to the support means, the method comprising the steps of:

a. predefining a rated load (MLmax) to be raised and lowered by the elevator system in the car;

b. predefining an empty weight (MK) of the car;

c. selecting at least one cable or belt as the support means, wherein the at least one cable or belt is coated with an elastomer material;

d. selecting the drive means from a plurality of drive means each with a different predetermined maximum traction force (MFmax), wherein the maximum traction force (MFmax) of the selected drive means is at least greater than half the rated load (MFmax>0.5×MLmax); e. after selecting the drive means, selecting the weight (MG), of the counterweight to be substantially equal to the empty weight (MK) and the difference between the rated load (MLmax) and the maximum traction force (MFmax) of the selected drive means (MG≈MK+(MLmax−MFmax)); and f. providing the selected drive means and the counterweight with the selected weight to the elevator system so that the drive means is able to hold, raise, and lower the car with the coupled counterweight remaining unchanged at the selected weight (MG) at all loads up to the predefined rated load (MLmax), the raising and lowering being at a same nominal speed profile.

* * * * *